US006340051B1

(12) United States Patent
Bloksma

(10) Patent No.: US 6,340,051 B1
(45) Date of Patent: Jan. 22, 2002

(54) HEAT EXCHANGER WITH BAFFLE PLATES

(75) Inventor: Walter Bloksma, Almere (NL)

(73) Assignee: Bloksma B.V., Almere (NL)

( * ) Notice: Subject to any disclaimer, the term of this patent is extended or adjusted under 35 U.S.C. 154(b) by 0 days.

(21) Appl. No.: 09/618,993

(22) Filed: Jul. 18, 2000

(30) Foreign Application Priority Data

Jul. 19, 1999 (NL) ..... 1012637

(51) Int. Cl.[7] ..... F28F 9/007; F28F 9/013; F28F 9/22

(52) U.S. Cl. ..... 165/159; 165/160

(58) Field of Search ..... 165/158, 159, 165/162

(56) References Cited

U.S. PATENT DOCUMENTS 1,338,479 A * 4/1920 Zimmermann ..... 165/159
2,552,416 A * 5/1951 Farkas ..... 165/159
4,215,745 A * 8/1980 Tuckmantel ..... 165/160
4,733,722 A * 3/1988 Forbes et al. ..... 165/159

FOREIGN PATENT DOCUMENTS

DE 119861 5/1976
GB 2142716 1/1985
SU 531994 B1 * 2/1977

* cited by examiner

*Primary Examiner*—Allen Flanigan
(74) *Attorney, Agent, or Firm*—Paul A. Lesko; Thompson Coburn LLP

(57) ABSTRACT

Heat exchanger provided with a housing having an inner wall, an inlet and an outlet for passing a first heat exchange medium through the housing. The housing furthermore has a core comprising a series of plate-shaped fins placed at least almost parallel to each other. Each fin is provided with pipe openings. A bundle of pipes is present for passing a second heat exchange medium, as well as a number of baffle plates, each baffle plate being provided with pipe openings. Each of the pipes extend through respective pipe openings of respective fins and respective baffle plates. Filling blocks are further provided, each having a bent base portion which has an outer surface. The bend of the base portion is such that the filling block closely abuts the inner wall of the housing. The filling block further has a rib projecting from the base portion to the centre of the housing when placed in the housing, which rib has a central slot. In said slot a respective baffle plate is accommodated.

25 Claims, 2 Drawing Sheets

HEAT EXCHANGER WITH BAFFLE PLATES

This patent application claims the benefit of priority under 35 U.S.C. §119(a) of Dutch Patent Application No. 1012637, filed Jul. 19, 1999. Dutch Patent Application No. 1012637 is herein incorporated herein in its entirety by reference.

TECHNICAL FIELD

The invention relates to a heat exchanger provided with a housing having an inner wall, an inlet and an outlet for passing a first heart exchange medium through the housing, having a core, comprising a series of plate-shaped fins placed at least almost parallel to each other, in which each fin is provided with pipe openings, and a bundle of pipes for passing a second heat exchange medium, and a number of baffle plates, in which each baffle plate is provided with pipe openings, in which each of the pipes extends through respective pipe openings of respective fins and respective baffle plates.

BACKGROUND OF THE DISCLOSURE

Such a heat exchanger is known from Dutch patent application 9500633. Although the known heat exchanger functions well, in some situations the operation may not be optimal. In said known heat exchanger, the baffle plates are namely situated loose against the inner wall of the housing, and the baffle plates only obtain their rigidity because the pipes pass through them. As a result, there is not only a chance that a quantity of first heat exchange medium, for instance oil, leaks through between the baffle plate and the inner wall of the housing, but there is also a chance that as a result of repetitive occurrence of pressure blasts the first heat exchange medium is subjected to, for instance during the cold start of motors, valves turn over and suchlike, unwanted bending of the baffle plates arises.

It is an objective of the present invention to provide a heat exchanger in which the above-mentioned problems are solved.

To that end, a heat exchanger of the kind mentioned above according to the present invention is characterized by filling blocks being provided, each having a bent base portion which has an outer surface, the bend of the base portion being such that the filling block closely abuts the inner wall of the housing, with a rib projecting from the base portion to the centre of the housing when placed in the housing, which rib has a central slot, in which slot a respective baffle plate is accommodated. Said filling block ensures that when a possible radial change of position occurs between the baffle plate and the inner wall of the housing, no leakage of the first heat exchange medium occurs. It is noted here that as a result of the pressure of the first heat exchange medium, the filling block is pressed against the inner wall of the housing. Furthermore the filling block increases the resistance of the baffle plates against bending, for instance as a result of pressure blasts.

In a preferred embodiment of a heat exchanger according to the invention, at least one of the filling blocks is made of elastic material. Preferably, the elastic material is a material that is resistant to the commonly used first heat exchange media, such as for instance mineral oils. As a result, in some cases, an improved absorbtion of pressure blasts active on the baffle plates and a further reduction of leakage is realized.

Preferably, at least one of the filing blocks is made of aluminum or an aluminum alloy. Said materials are extremely resistant to the commonly used first heat exchange media.

In order to obtain a correct pressing of the outer surface of the base portion against the inner wall of the housing, according to an embodiment of the invention, at least one of the filling blocks is provided with a spring which is situated in the slot between the baffle plate concerned and the bottom of the slot.

A further improved pressing of the filling block against the inner wall of the housing is obtained when the outer surface of the base portion of at least one of the filling blocks shows two different curvature radiuses $R_1$, $R_2$, in which $R_1$ is the curvature radius of the central part of the base portion, $R_2$ is the curvature radius of the parts of the base portion that are situated outside of the central part, $R_1$ being larger than $R_2$. Preferably the curvature radiuses have different centres.

Preferably, the projecting rib is provided with a bore hole, for accommodating an attachment means for attaching a filling block to the baffle plate concerned.

Some embodiments of a heat exchanger according to the present invention will by way of example be described on the basis of the drawing.

DETAILED DESCRIPTION OF THE DRAWINGS

FIG. 1 schematically shows a longitudinal cross-section of a heat exchanger according to the present invention;

SUMMARY OF THE INVENTION

Figure 1:
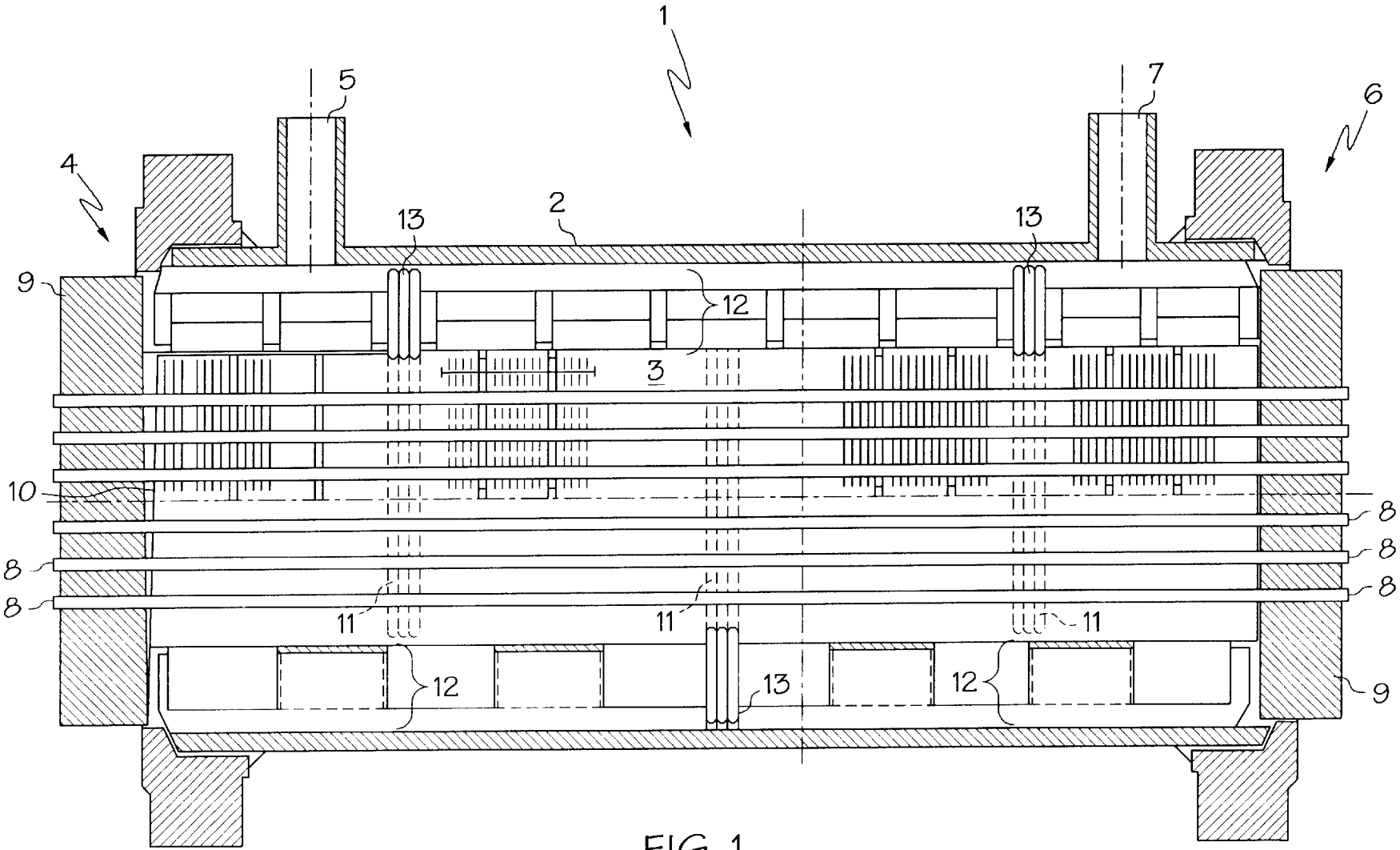

The heat exchanger 1 as shown in the drawing comprises a substantially cylindrical housing 2 having a core 3 accommodated in there. At the top side near a first end 4, the housing 2 has an inlet 5 and at the opposite side 6 an outlet 7. The inlet 5 and the outlet 7 can be connected to a supply and return lead for the first heat exchange medium, for instance oil to be cooled. During use, apart from the inlet 5 and outlet 7, the housing 2 with the core 3 accommodated in there is entirely enclosed, and the oil can be led through the housing under high pressure. The inlet and the outlet may for that matter also be differently positioned and several inlets and/or outlets may be arranged.

The core 3 comprises a bundle of pipes 8 extending almost parallel to each other and in longitudinal direction of the housing 2. On both ends of the core 3 an end plate 9 has been arranged which can fittingly be accommodated in or against the housing 2. The pipes 8 extend through the end plates, as a result of which the ends of the pipes are open and may be connected to a supply and discharge, respectively, of a second heat exchange medium, for instance water or a cooling fluid. Between the end plates 9 a large number of fins 10 have been arranged which extend almost parallel to the end plates and to each other, through which finds the pipes 8 extend, The finds 10 therefore extend almost at right angles to the longitudinal direction of the pipes 8 and are placed at a little distance from each other. The fins 10 and the pipes contact each other closely, for instance because the pipes 8 are somewhat flared within the fins 10, as a result of which good heat conductance between the fins 10 and the pipes 8 is guaranteed. The fins 10 and the pipes 8 may of course for that matter also be connected one to the other in a conducting manner in other ways.

In the cylindrical housing 2 furthermore a number of baffle plates 11 are arranged, each provided with pipe openings, which at one side abut the inner wall of the housing 2 and at the opposite side are situated at a distance from the inner wall of housing 2. Because of this distance a window is formed. These baffle plates 11 ensure that the flow direction of the first heat exchange medium, for instance oil to be cooled, is reversed again and again, so that the first heat exchange medium as it were flows through the core 3 in a zigzag manner, as a result of which an improved heat exchange arises. The pipes 8 also extend through the baffle plates 11, and are thus fixated in position. In case that there are no pipes 8 in the window, it regards a NTIW (no tubes in window) heat exchanger.

In the known heat exchanger the baffle plates lie loose against the inner wall of the housing, and the baffle plates obtain their rigidity only because the pipes pass through them. As a result there is not only a chance that a quantity of first heat exchange medium, for instance oil, leaks through between the baffle plate and inner wall of the housing, but there is also a chance that as a result of repetitive occurrence of pressure blasts the first heat exchanger medium is subjected to, for instance during the cold start of motors, valves turn over and suchlike unwanted bending of the baffle plates arises.

Figure 2:
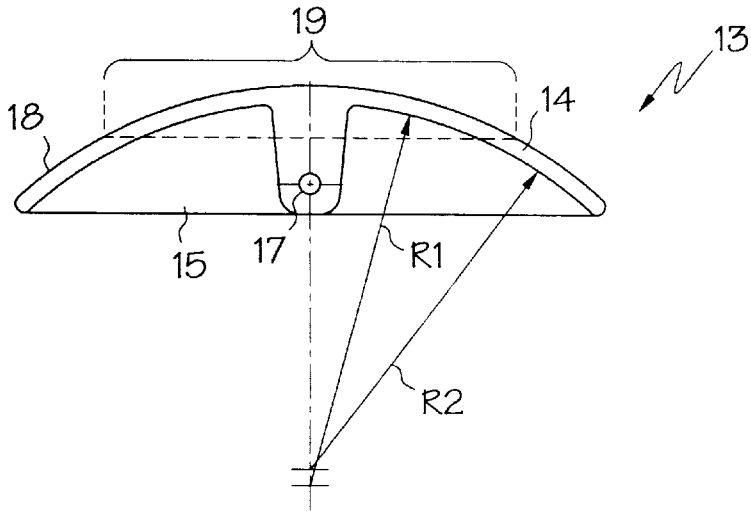
FIG. 2 shows a side view of a filling block of a heat exchanger according to the invention.
Figure 3:
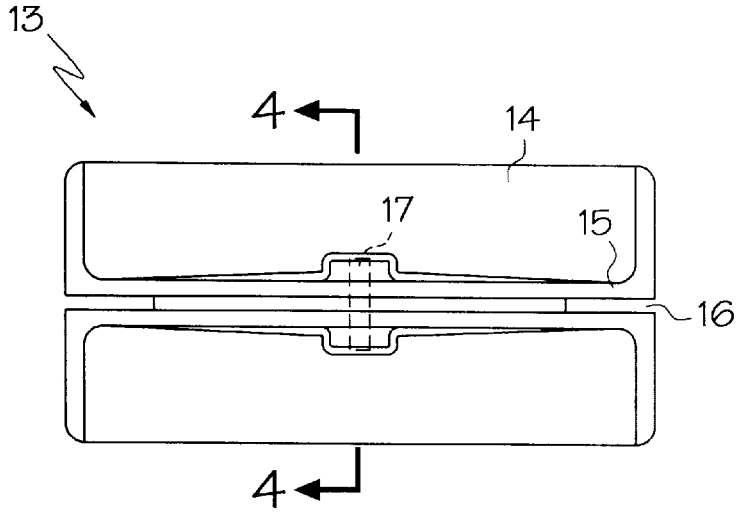
FIG. 3 shows a top view of FIG. 2.
Figure 4:
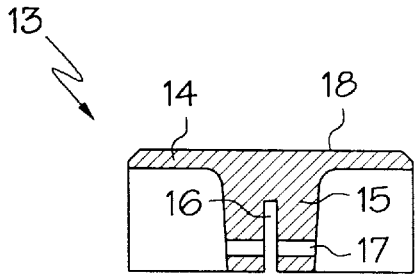
FIG. 4 shows a cross-section along the line IV—IV in FIG. 3.

The present invention solves these problems by placing a so-called filling block 13 between the baffle plate 11 and the inner wall of the housing 2. Said filling block 13 is shown in more detail in the FIGS. 2–4.

Said filling block 13 has a bent base portion 14, having an outer surface 18. The bend of the base portion 14 is such that the filling block closely abuts the inner wall of the housing 2. Furthermore the filling block 13 has a rib 15 projecting from the base portion 14 of the centre of the housing 2 when placed in the housing 2, which rib has a central slot 16, in which slot 16 a baffle plate 11 concerned can be accommodated. Said filling block 13 ensures that when a possible radial change of position occurs between the baffle plate 11 and the inner wall of the housing 2, no leakage of the first heat exchange medium occurs. It is noted here that as a result of the pressure of the first heat exchange medium, the filling block 13 is pressed against the inner wall of the housing 2. Furthermore the filling block 13 increases the resistance of the baffle plates 11 against bending, for instance as a result of pressure blasts. In the flow direction, that is the direction transverse to a baffle plate 11, the filling block 13 has a certain length which is sufficient to prevent tilting of the baffle plate and to increase the leakage resistance.

Preferably the filling block 13 is made of elastic material, so that in some cases an improved absorbtion of pressure blasts by the baffle plates 11 and a further reduction of leakage is realised. In this case, and also in other cases, the projecting rib 15 may possibly be provided with a bore hole 17, for accommodating an attachment means (not shown) for attaching the filling block 13 to the baffle plate 11 concerned. It should be noted here that the elastic material is a material that is resistant to the commonly used first heat exchange media, such as for instance mineral oils which may reach a temperature of 130 degrees C.

An extremely suitable material for the filling block 13 is aluminum or an aluminum alloy, which are highly resistant against the commonly used first heat exchange media. In order to particularly, but not exclusively, obtain a correct pressing of the outer surface 18 of the base portion 14 against the inner wall of the housing, a spring is for instance provided which is situated in the slot 16 between the baffle plate 11 and the bottom of the slot 16. Alternatively or additionally, the outer surface 18 of the base portion 14 may show two different curvature radiuses $R_1$, $R_2$, in which $R_1$ is the curvature radius of a central part 19 of the base portion 14, $R_2$, is the curvature radius of the parts of the base portion that are situated outside of central part 19, $R_1$ being larger than $R_2$. As a result an improved pressing of the filling block 13 against the inner wall of the housing 2 is obtained. Preferably the curvature radiuses $R_1$ and $R_2$ have different centres.

Said measures, a spring in the slot and an outer surface having different curvature radiuses, may also be applied in a filling block of elastic or another material.

It will be clear that the invention is not limited to the embodiment described above by way of example, but that to the expert numerous variations are possible within the scope of protection of the claims.

What is claimed is:

1. A heat exchanger comprising a housing having an inner wall, an inlet and an outlet for passing a first heat exchange medium through the housing, said housing having a core comprising a series of plate-shaped fins placed at least almost parallel to each other, in which each fin is provided with pipe openings, and a bundle of pipes for passing a second heat exchange medium, and a number of baffle plates, in which each baffle plate is provided with pipe openings, in which each of the pipes extends through respective pipe openings of respective fins and respective baffle plates, characterized by filling blocks being provided, each having a bent base portion which has an outer surface, the bend of the base portion being such that the filling block closely abuts the inner wall of the housing, with a rib projecting from the base portion to the center of the housing when placed in the housing, which rib has a central slot, in which slot a respective baffle plate is accommodated.

2. The heat exchanger of claim 1, wherein at least one of the filling blocks is made of elastic material.

3. The heat exchanger of claim 2, wherein the elastic material comprises a material resistant to the commonly used first heat exchange media, such as for instance mineral oils.

4. The heat exchanger of claim 1, wherein at least one of the filling blocks is made of aluminum or an aluminum alloy.

5. The heat exchanger of claim 1, wherein at least one of the filling blocks is provided with a spring which is situated in the slot between the baffle plate concerned and the bottom of the slot.

6. The heat exchanger of claim 2, wherein at least one of the filling blocks is provided with a spring which is situated in the slot between the baffle plate concerned and the bottom of the slot.

7. The heat exchanger of claim 3, wherein at least one of the filling blocks is provided with a spring which is situated in the slot between the baffle plate concerned and the bottom of the slot.

8. The heat exchanger of claim 4, wherein at least one of the filling blocks is provided with a spring which is situated in the slot between the baffle plate concerned and the bottom of the slot.

9. The heat exchanger of claim 1, wherein the outer surface of the base portion of at least one of the filling blocks shows two different curvature radiuses $R_1$, $R_2$, in which $R_1$ is the curvature radius of a central part of the base portion, $R_2$ is the curvature radius of the parts of the base portion that are situated outside of central part, $R_1$ being larger than $R_2$.

10. The heat exchanger of claim 2, wherein the outer surface of the base portion of at least one of the filling blocks shows two different curvature radiuses $R_1$, $R_2$, in which $R_1$ is the curvature radius of a central part of the base portion, $R_2$ is the curvature radius of the parts of the base portion that are situated outside of central part, $R_1$ being larger than $R_2$.

11. The heat exchanger of claim 3, wherein the outer surface of the base portion of at least one of the filling blocks shows two different curvature radiuses $R_1$, $R_2$, in which $R_1$ is the curvature radius of a central part of the base portion, $R_2$ is the curvature radius of the parts of the base portion that are situated outside of central part, $R_1$ being larger than $R_2$.

12. The heat exchanger of claim 4, wherein the outer surface of the base portion of at least one of the filling blocks shows two different curvature radiuses $R_1$, $R_2$, in which $R_1$ is the curvature radius of a central part of the base portion, $R_2$ is the curvature radius of the parts of the base portion that are situated outside of central part, $R_1$ being larger than $R_2$.

13. The heat exchanger of claim 5, wherein the outer surface of the base portion of at least one of the filling blocks shows two different curvature radiuses $R_1$, $R_2$, in which $R_1$ is the curvature radius of a central part of the base portion, $R_2$ is the curvature radius of the parts of the base portion that are situated outside of central part, $R_1$ being larger than $R_2$.

14. The heat exchanger of claim 6, wherein the outer surface of the base portion of at least one of the filling blocks shows two different curvature radiuses $R_1$, $R_2$, in which $R_1$ is the curvature radius of a central part of the base portion, $R_2$ is the curvature radius of the parts of the base portion that are situated outside of central part, $R_1$ being larger than $R_2$.

15. The heat exchanger of claim 7, wherein the outer surface of the base portion of at least one of the filling blocks shows two different curvature radiuses $R_1$, $R_2$, in which $R_1$ is the curvature radius of a central part of the base portion, $R_2$ is the curvature radius of the parts of the base portion that are situated outside of central part, $R_1$ being larger than $R_2$.

16. The heat exchanger of claim 8, wherein the outer surface of the base portion of at least one of the filling blocks shows two different curvature radiuses $R_1$, $R_2$, in which $R_1$ is the curvature radius of a central part of the base portion, $R_2$ is the curvature radius of the parts of the base portion that are situated outside of central part, $R_1$ being larger than $R_2$.

17. The heat exchanger of claim 9, wherein the curvature radiuses have different centers.

18. The heat exchanger of claim 10, wherein the curvature radiuses have different centers.

19. The heat exchanger of claim 11, wherein the curvature radiuses have different centers.

20. The heat exchanger of claim 12, wherein the curvature radiuses have different centers.

21. The heat exchanger of claim 13, wherein the curvature radiuses have different centers.

22. The heat exchanger of claim 14, wherein the curvature radiuses have different centers.

23. The heat exchanger of claim 15, wherein the curvature radiuses have different centers.

24. The heat exchanger of claim 16, wherein the curvature radiuses have different centers.

25. The heat exchanger of claim 1, wherein the projecting rib is provided with a bore hole, for accommodating an attachment means for attaching a filling block said baffle plate.

* * * * *